US006227107B1

(12) United States Patent
Hashimoto et al.

(10) Patent No.: US 6,227,107 B1
(45) **Date of Patent: *May 8, 2001**

(54) STENCIL PRINTER

(75) Inventors: Tetsuya Hashimoto; Toshihiro Bansyo; Masakazu Miyata; Hitoshi Watanabe, all of Ibaraki-ken (JP)

(73) Assignee: Riso Kagaku Corporation, Tokyo (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/165,211

(22) Filed: Oct. 2, 1998

(30) Foreign Application Priority Data

Oct. 7, 1997 (JP) ..... 9-274253

(51) Int. Cl.[7] ..... B41L 13/06
(52) U.S. Cl. ..... 101/116; 101/118
(58) Field of Search ..... 101/116, 118, 101/129, 119; 400/703, 711, 716, 701

(56) References Cited

U.S. PATENT DOCUMENTS

| | | | | |
|---|---|---|---|---|
| 3,941,053 | * | 3/1976 | Black et al. | 101/124 |
| 4,030,409 | * | 6/1977 | Adhikari et al. | 101/47 |
| 4,088,800 | * | 5/1978 | Nicholson | 427/8 |
| 4,123,569 | * | 10/1978 | Peterson et al. | 427/141 |
| 5,507,225 | * | 4/1996 | Noguchi | 101/116 |
| 5,537,920 | * | 7/1996 | Hasegawa et al. | 101/116 |
| 5,609,101 | * | 3/1997 | Oyama et al. | 101/116 |
| 5,694,841 | * | 12/1997 | Sato | 101/116 |

FOREIGN PATENT DOCUMENTS

| | | | | |
|---|---|---|---|---|
| 0040179 | * | 2/1986 | (JP) | 101/116 |

* cited by examiner

*Primary Examiner*—John S. Hilten
*Assistant Examiner*—Anthony H. Nguyen
(74) *Attorney, Agent, or Firm*—Nixon Peabody LLP; Donald R. Studebaker

(57) ABSTRACT

A stencil printer has a rotary printing drum removably supported in a printer body. A lamp is provided inside the printer body, and a control circuit permits, in response to an action necessary for maintenance of the printer body, the lamp means to be turned on.

4 Claims, 6 Drawing Sheets

STENCIL PRINTER

BACKGROUND OF THE INVENTION

1. Field of the Invention

This invention relates to a stencil printer, and more particularly to a stencil printer in which a printing drum is removably mounted on a printer body.

2. Description of the Related Art

In a rotary press type stencil printer, the printing drum is mounted in a printer body to be rotatable about a predetermined axis of rotation, and is removed from the printer body by moving the printing drum in the direction of the axis of rotation. By removing the printing drum, maintenance of the printer body is facilitated, for instance, when the rotation of the printing drum becomes out of synchronization with paper supply or the printer gets jammed with paper. In such a case, rollers and or a paper drum for conveying the printing paper can become stained with ink, and accordingly the rollers and the paper drum must be cleaned and maintenance must be performed.

However, conventionally, since the inside of the printer body is dark, the stained part and/or malfunctioning parts are difficult to view and maintenance is very difficult.

SUMMARY OF THE INVENTION

In view of the foregoing observations and description, the primary object of the present invention is to provide a stencil printer in which maintenance of the printer body is facilitated.

The stencil printer of the present invention is one comprising a rotary printing drum removably supported in the printer body and is characterized by having a lamp means provided inside the printer body, and a control means which, in response to an action necessary for maintenance inside the printer body, turns in the lamp means.

The action necessary for maintenance of the printer body may be any action such as opening the door of the printer body, removal of the printing drum, and the like which are necessary for checking the inside of the printer body, removal of jammed paper and cleaning of rollers and/or a paper drum stained with ink. This action will be simply referred to as "a maintenance action", hereinbelow.

For example, the control means may be provided with a detecting means which detects removal of the printing drum and may turn on the lamp means when the detecting means detects that the printing drum has been removed from the printer body.

Otherwise the control means may comprise a detecting means which detects removal of the printing drum and a switch means which can turned on the lamp means only when the detecting means detects that the printing drum has been removed from the printer body.

In this case, it is preferred that a drum takeout switch which is operated to permit the printing drum to be removed from the printer body doubles as said switch means.

Preferably the lamp means is disposed in a position where it can illuminate the space for the printing drum.

In the stencil printer of the present invention, since the lamp means is turned on in response to a maintenance action, the inside of the printer body can be illuminated by the lamp means when maintenance is to be carried out. Accordingly cleaning of the rollers or the drum for conveying printing paper sheets and/or inspection of the parts is facilitated.

When the lamp means is arranged to be turned on when the detecting means detects that the printing drum has been removed from the printer body, the lamp means can be automatically turned on in response to removal of the printing drum without the necessity of any additional action.

Further by providing a switch means which can turned on the lamp means only when the detecting means detects that the printing drum has been removed from the printer body, it becomes possible to turn on the lamp means only when necessary and power consumption can be reduced.

When the drum takeout button doubles as the switch for turning on the lamp means, the number of components of the printer is reduced and the manufacturing cost of the printer can be reduced.

By disposing the lamp means in a position where it can illuminate the space where the printing drum exists, the space can be surely illuminated when the printing drum is removed and maintenance is further facilitated.

DESCRIPTION OF THE PREFERRED EMBODIMENT

Figure 1:
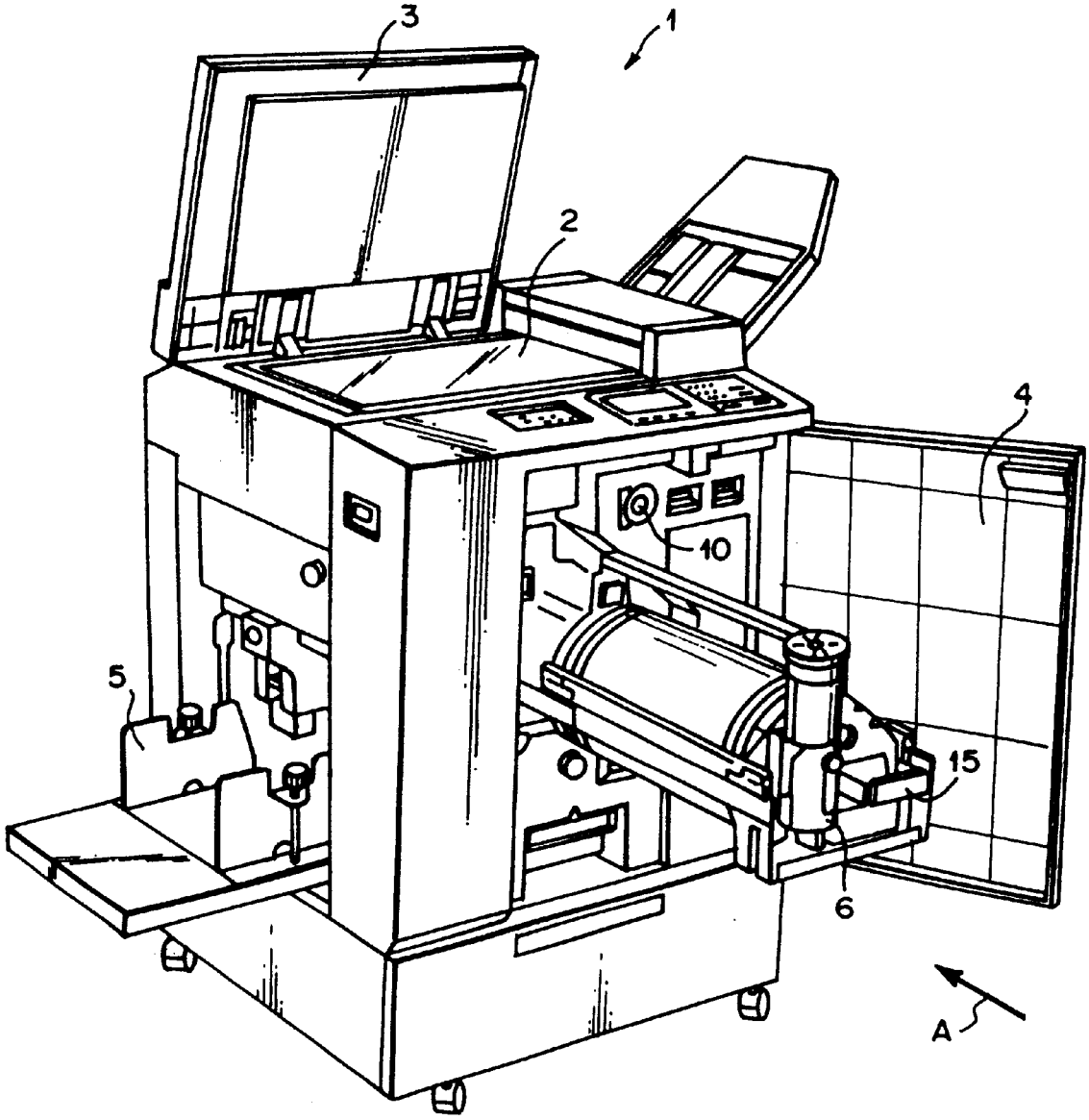
FIG. 1 is a perspective view of a stencil printer in accordance with an embodiment of the present invention.

As shown in FIG. 1, a stencil printer 1 in accordance with an embodiment of the present invention comprises a printer body 2, an original table cover 3 for bringing an original placed on an original table (provided on the top of the printer body 2) into close contact with the original table, and a front cover 4 for opening and closing the front face of the printer body 2. A paper supply table 5 is disposed on the left (as seen in FIG. 1) side of the printer body 2. A printing drum 6 is mounted in the printer body 2.

Figure 2:
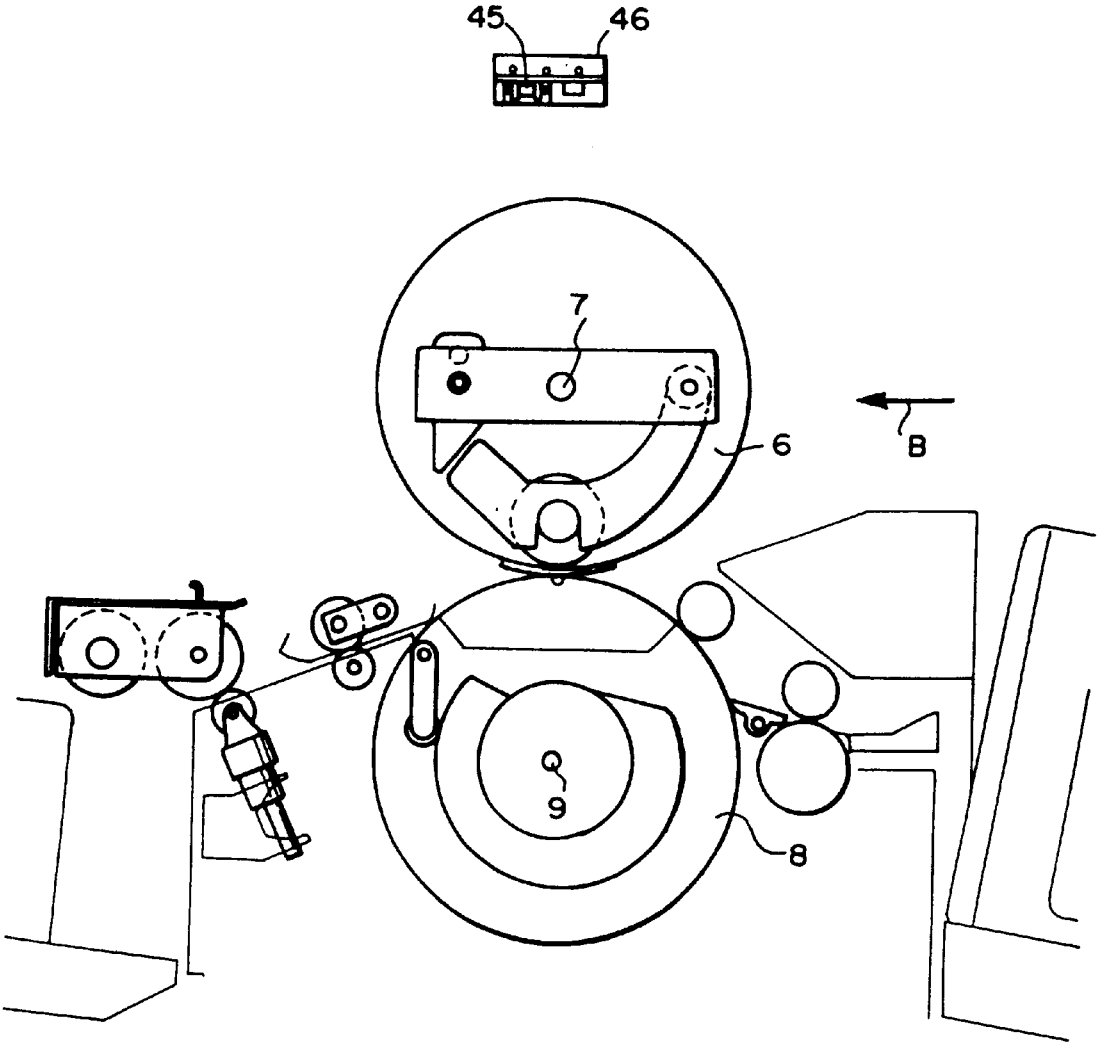
FIG. 2 is a view showing the internal structure of the stencil printer as viewed in the direction of arrow A in FIG. 1.

As shown in FIG. 2, a paper drum 8 which is rotatable about a shaft 9 parallel to the printing drum 6 is mounted in the printer body 2 and is opposed to the printing drum 6. A stencil master is wrapped around the printing drum 6 and a printing paper sheet is wrapped around the paper drum 8. The printing drum 6 and the paper drum 8 are positioned relative to each other and are rotated in synchronization with each other, whereby ink is transferred to the printing paper sheet on the paper drum 8 in the pattern of perforations on the stencil master on the printing drum 6.

Figure 3:
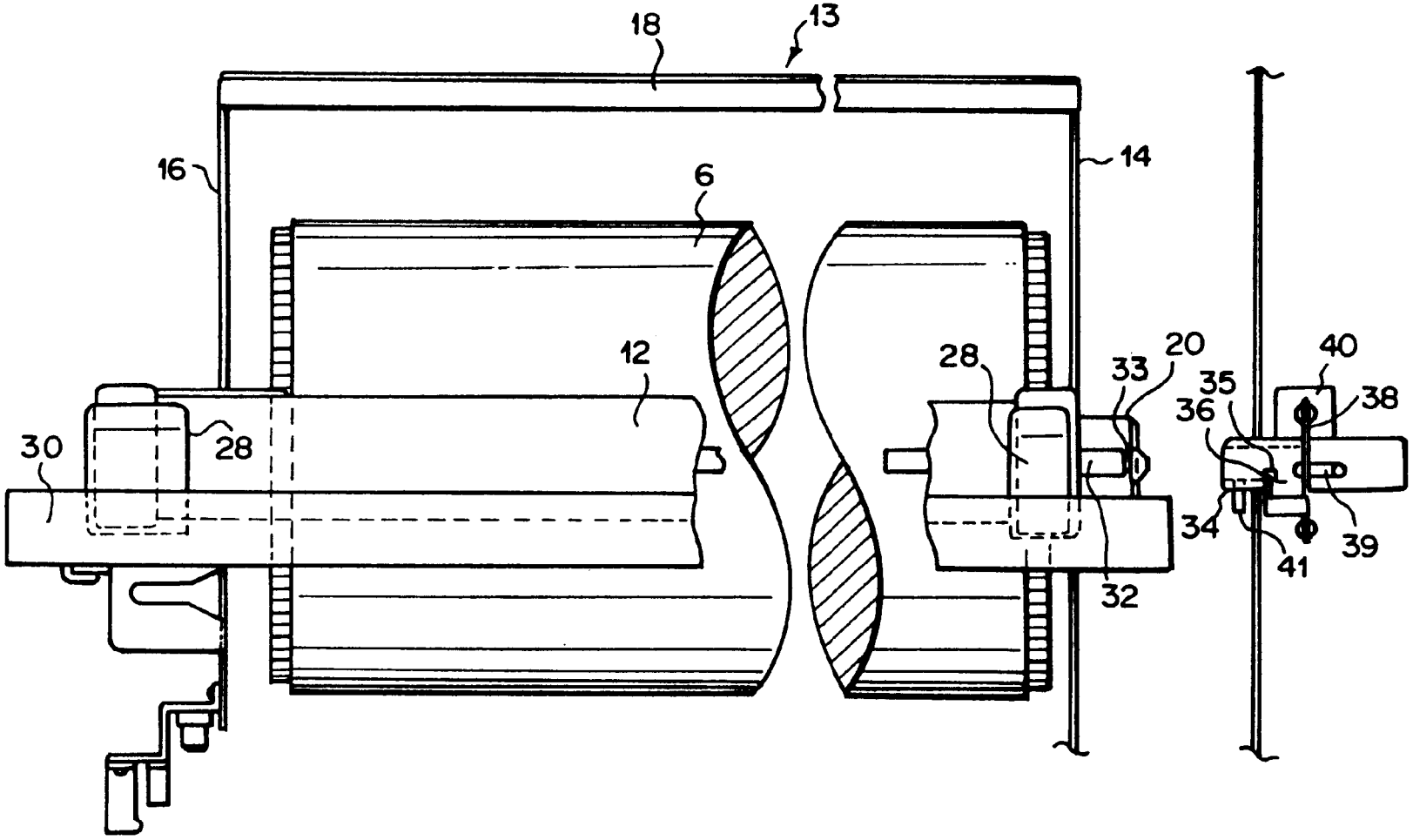
FIG. 3 is a view showing the structure of the printing drum as viewed in the direction of arrow B in FIG. 2.

As shown in FIGS. 2 and 3, the printing drum 6 is supported for rotation about a shaft 7 with the position in the axial direction fixed by a drum support means 13. The drum support means 13 comprises a pair of side frames 12, a pair of end plates 14 and 16, a lift handle 18 for lifting the printing drum 6, and a bearing 20. The drum support means 13 is suspended from an intermediate rail (not shown) by way of hangers 28 at the side frames 12. The intermediate rail is movable along a pair of fixed rails 30 which are fixed in the printer body 2. The drum support means 13 is provided with a pull handle 15 (FIG. 1) at the end plate 16, and by pulling or pushing the pull handle 15, the printing drum 6 can be moved in the axial direction together with the drum support means 13.

In the state shown in FIG. 3, the printing drum 6 is in an operational position slightly displaced leftward from a position in which it is positioned when inserted home into the printer body 2. When the pull handle 15 is pulled leftward from the position shown in FIG. 3, the drum support means 13 is moved outside the printer body 2, and when the lift handle 18 is pulled upward, the drum support means 13 can be lifted together with the printing drum 6 with the side frames 12 disengaged from the hangers 28. Thus the printing drum 6 is removed from the printer body 2.

As shown in FIG. 3, an engagement rod 32 projects from the end plate 14 of the drum support means 13 in parallel to the shaft 7 of the printing drum 6. The printer body 2 is provided with a socket 34 which receives the engagement rod 32. The engagement rod 32 is provided with an annular groove 33 formed near the tip of the rod 32 and the socket 34 is provided with a lateral groove 35 which is brought into alignment with the annular groove 33 when the engagement rod 32 is fully inserted into the socket 34. An engagement piece 36 is brought into engagement with the annular groove 33 through the lateral groove 35, thereby preventing the engagement rod 32 and the socket 34 from moving relative to each other in the axial direction.

The engagement piece 36 is supported on one end of a link 38 which is rotatable about a pin 39. The other end of the link 38 is connected to an actuator of a solenoid 40 mounted on the socket 34. The link 38 is urged by an urging means such as a spring (not shown) in a direction in which the engagement piece 36 is inserted into the lateral groove 35. The solenoid 40 is energized in response to depression of a drum takeout button 10 (FIG. 1) on the front side of the printer body 2. When the solenoid 40 is energized, the link 38 is rotated overcoming the force of the urging means to draw out the engagement piece 36 from the lateral groove 35, thereby permitting the engagement rod 32 from being disengaged from the socket 34.

The socket 34 is provided with a photosensor 41 which detects that the engagement rod 32 is in the socket 34. That is, the photosensor 41 emits a light beam and outputs a detecting signal upon receipt of reflected light from the engagement rod 32. Accordingly so long as the engagement rod 32 is in the socket 34, the photosensor 41 keeps outputting the detecting signal, and when the engagement rod 32 is drawn out from the socket 34, the photosensor 41 stops outputting the detecting signal.

Figure 4:
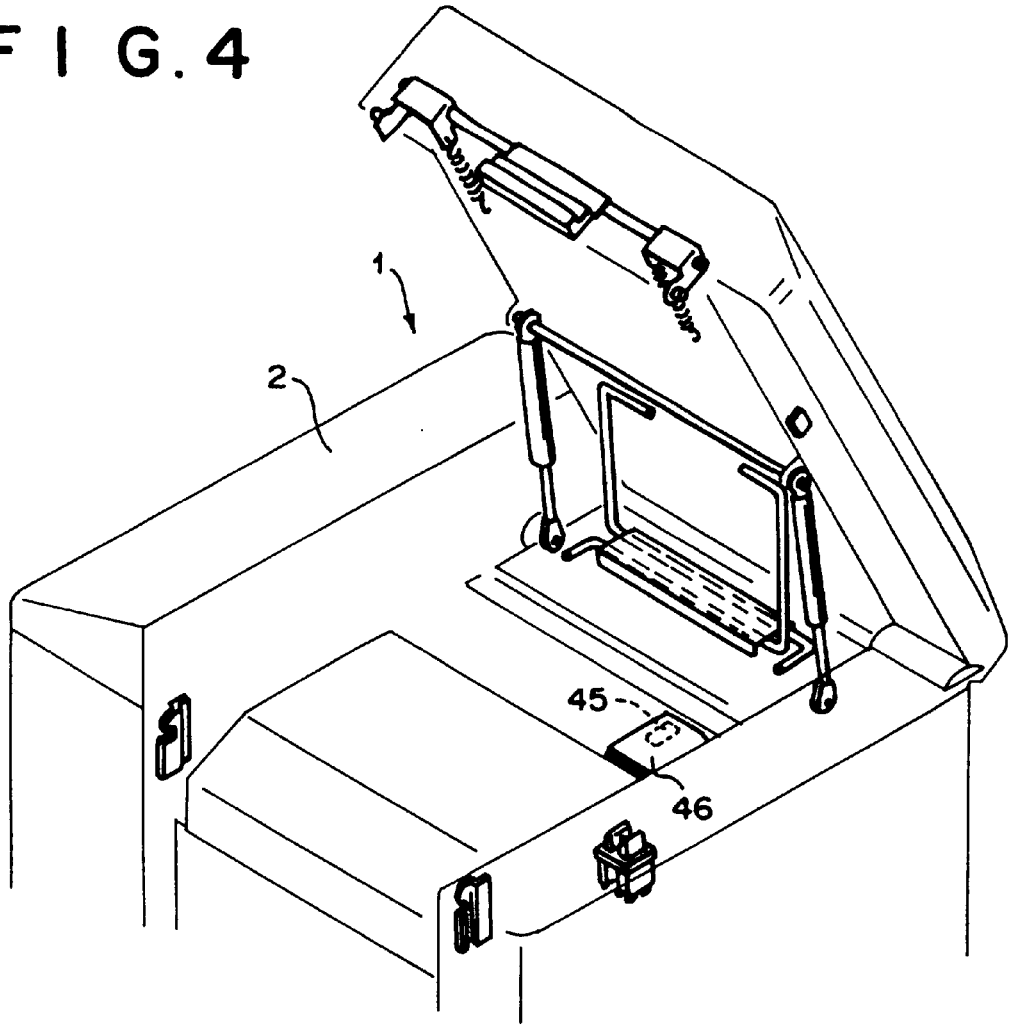
FIG. 4 is a rear perspective view showing the stencil printer with the original table lifted.
Figure 5:
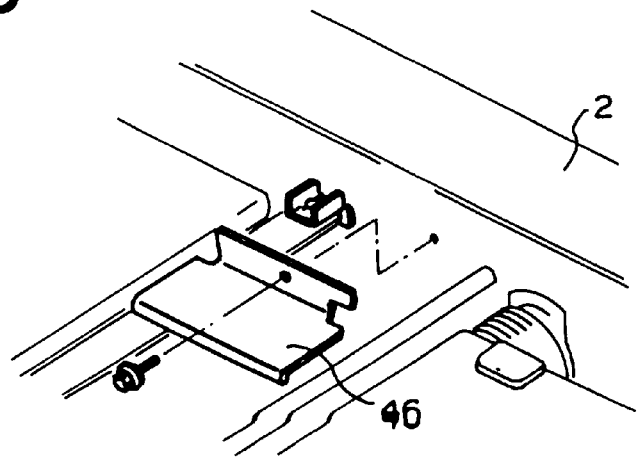
FIG. 5 is a view showing the lamp bracket.

As shown in FIGS. 2 and 4, a lamp 45 illuminating the inside of the printer body 2 is disposed above the printing drum 6. The lamp 45 is mounted on the rear side of the inside of the printer body 2 by way of a bracket 46. As shown in FIG. 5, the bracket 46 is fixed to the rear side of the printer body 2 by a screw.

Figure 6:
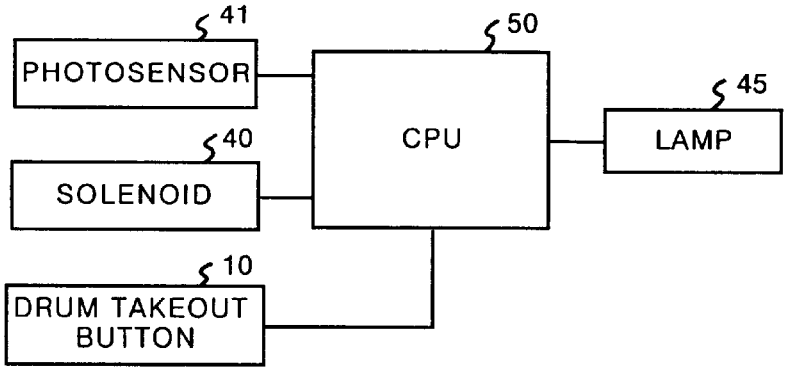
FIG. 6 is a block diagram showing the control system for controlling the lamp.

The lamp 45 is turned on and off under the control of a control system shown in FIG. 6. In FIG. 6, the control system comprises a CPU 50 to which the photosensor 41, the solenoid 40, the drum takeout button 10 and the lamp 45 are connected. The CPU 50 causes the solenoid 40 to be energized in response to depression of the drum takeout button 10.

The operation of the lamp 45 in this embodiment will be described with reference to the flow chart shown in FIG. 7, hereinbelow. In idle state where the drum takeout button 10 has not been depressed, the photosensor 41 inputs the detecting signal into the CPU 50. Then when the drum takeout button 10 is depressed (step S1), the solenoid 40 is energized and the engagement piece 36 is drawn out from the lateral groove 35 in the manner described above. When the pull handle 15 of the drum support means 13 is pulled and the drum support means 13 is drawn out from the printer body 2, the engagement rod 32 is drawn out from the socket 34 and accordingly input of the detecting signal into the CPU 50 from the photosensor 41 is terminated since the photosensor 41 can no longer receive reflecting light from the engagement rod 32. When input of the detecting signal from the photosensor 41 is terminated, the CPU 50 turns on the lamp 45 (step S3). Then determination whether the detecting signal from the photosensor 41 is turned on is repeated until input of the detecting is resumed (step S4).

In this state, maintenance of the printer such as cleaning of the paper drum 8, checking of the parts of the printer body 2 and the like is carried out.

When the drum support means 13 is remounted on the printer body 2 after completion of maintenance, the engagement rod 32 is inserted into the socket 34. At this time since the tip of the engagement rod 32 is substantially conical, the engagement piece 36 is slid on the engagement rod 32 while pushed outward overcoming the force of the urging means as the engagement rod 32 is inserted deep into the socket 34 and when the engagement piece 36 is aligned with the annular groove 33 on the engagement rod 32, the engagement piece 36 falls into engagement with the annular groove 33 under the force of the urging member, thereby locking the engagement rod 32 and the socket 34.

In this state, since the photosensor 41 can receive reflected light from the engagement rod 32, input of the detecting signal into the CPU 50 is resumed and the lamp 45 is turned off (steps S4 and S5).

The printing drum 6 is removed from the printer body 2 generally when the aforesaid maintenance is to be carried out. In this embodiment, since the lamp 45 is turned on and illuminates the paper drum 8 and the inside of the printer body 2 with the printing drum 6 removal when the maintenance is to be carried out, stains and or damaged parts can be easily found and the maintenance is facilitated.

Though in the embodiment described above, the lamp 45 is turned on after the drum takeout button 10 is depressed, the printing drum 6 is removed from the printer body 2 and the detecting signal from the photosensor 41 is turned off, the lamp 45 may be turned on in other various manners. For example, the lamp 45 may be turned on in response to depression of the drum takeout button 10. In this case, the lamp 45 may be turned off in the same manner as in the embodiment described above or may be turned off in response to depression of the drum takeout button 10 upon remount of the printing drum 6.

In another embodiment of the present invention, the lamp 45 is manually turned on by depressing the drum takeout button 10 after removal of the printing drum 6. This embodiment will be described with reference to the flow chart shown in FIG. 8, hereinbelow.

Figure 7:
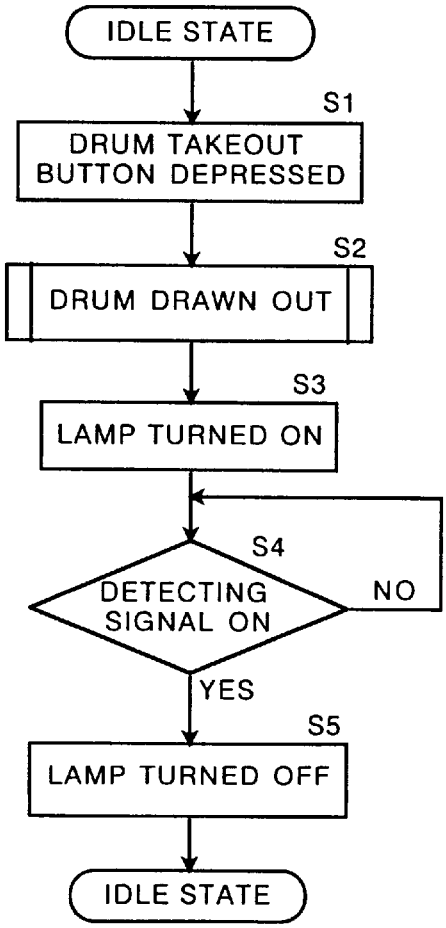
FIG. 7 is a flow chart for illustrating the operation of the stencil printer.
Figure 8:
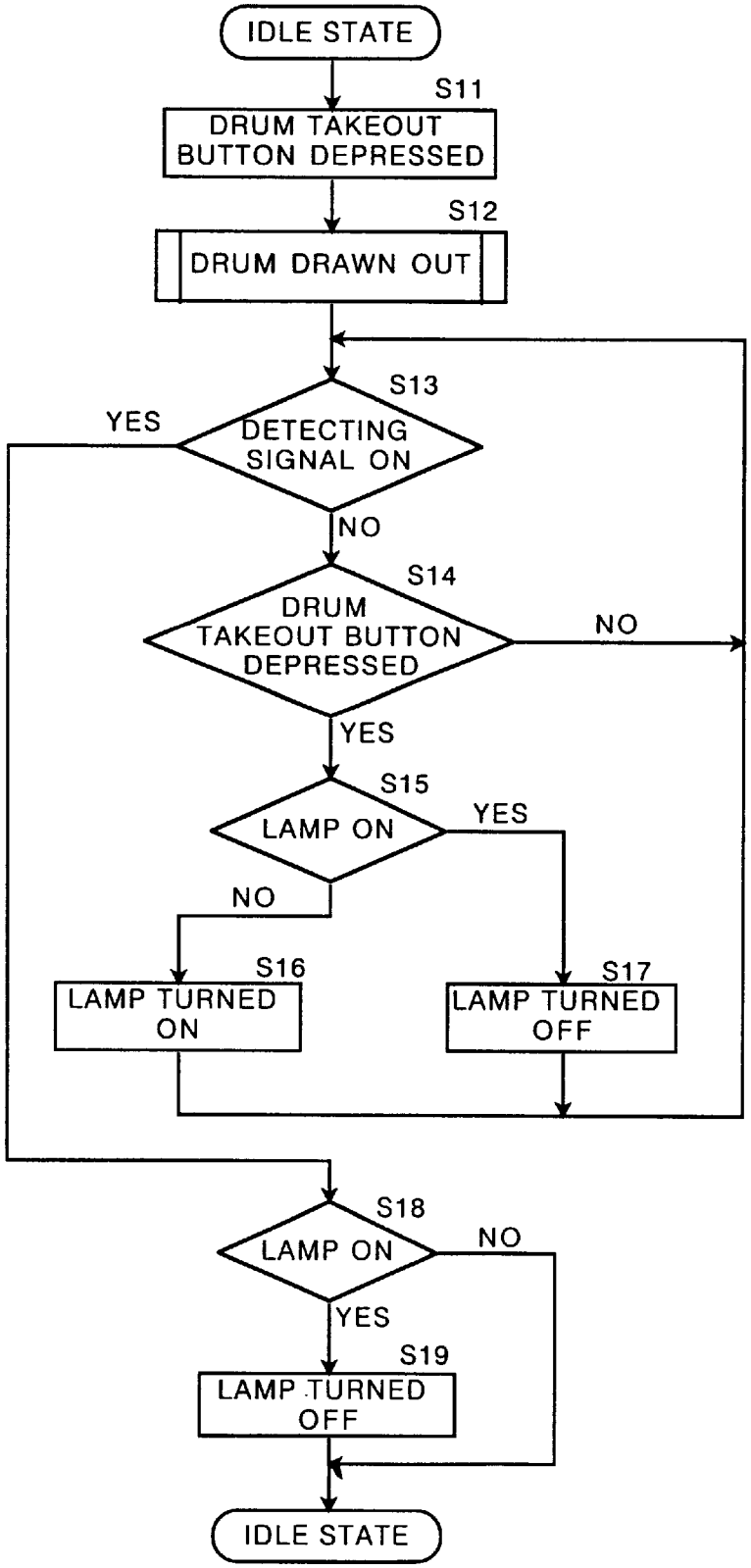
FIG. 8 is a flow chart for illustrating the operation of a stencil printer in accordance with another embodiment of the present invention.

In the flow chart shown in FIG. 8, steps S11 and S12 are the same as steps S1 and S2 in the flow chart shown in FIG. 7 and will not be described here. After the printing drum 6 is removed from the printer body 2, it is determined whether the detecting signal from the photosensor 41 is turned on (step S13). Since the photosensor 41 does not output the detecting signal when the printing drum 6 is removed from the printer body 2 as described above, the answer to the question in step S13 is no and accordingly it is determined whether the drum takeout button 10 has been depressed (step S14). Steps S13 and S14 are repeated until the drum takeout button 10 is depressed. When the drum takeout button 10 is depressed, then it is determined whether the lamp 45 is on (step S15). Immediately after removal of the printing drum 6, the lamp 45 is kept off and accordingly the lamp 45 is turned on in step S16 and then step S13 is repeated. In this state, until the printing drum 6 is remounted on the printer body 2 and the drum takeout button 10 is depressed, steps S13 and S14 are repeated and the lamp 45 is kept on.

When the drum takeout button 10 is depressed in this state, step S15 is executed and the lamp 45 is turned off (step S17). Thereafter step S13 is executed. Thus by steps S13 to S17, the lamp 45 is turned alternately on and off in response to depression of the drum takeout button 10.

When the printing drum 6 is remounted on the printer body 2, the detecting signal from the photosensor 41 is turned on and step S18 is executed after step S13. If the lamp 45 is not on, the processing is directly ended and if the lamp 45 is on, the processing is ended after turning off the lamp 45 in step S19. Accordingly, when the printing drum 6 is remounted, the lamp 45 is invariably turned off.

Thus in this embodiment, the lamp 45 is turned on when the drum takeout button 10 is depressed after removal of the printing drum 6. Accordingly the lamp 45 can be turned on only when necessary during maintenance and power consumption can be reduced. Further since the drum takeout button 10 doubles as a switch for turning on the lamp 45, the number of components of the printer is reduced and the manufacturing cost of the printer can be reduced.

A switch for turning on the lamp 45 may be provided separately from the drum takeout button 10.

In the embodiments described above, the lamp 45 is disposed above the printing drum 6. However the lamp 45 may be disposed in any position in which it can illuminate the inside of the printer body 2. Further though in the embodiments described above, the lamp 45 is turned off immediately after receipt of the detecting signal, the lamp 45 may be turned off after a certain delay time. Further though in the embodiments described above, the lamp 45 is turned on or is permitted to be turned on in response to removal of the printing drum 6, the lamp 45 may be turned on or may be permitted to be turned on, for instance, in response to opening of the front cover 4 or in response to detecting of paper jamming.

Though in the embodiments described above, the present invention has been applied to a stencil printer in which printing paper sheets are pressed against the printing drum 6 by use of a paper drum, the present invention may be applied to a stencil printer in which printing paper sheets are pressed against the printing drum 6 by use of a roller in place of the paper drum.

What is claimed is:

1. A stencil printer comprising:

a rotary printing drum removably supported in a printer body;

a detecting means for detecting removal of said rotary printing drum;

a lamp means for illuminating an inside of the printer body, and a control means for activating the lamp means when the detecting means detects that the rotary printing drum has been removed from the printer body.

2. A stencil printer as defined in claim 1 in which the lamp means is disposed in a position where it can illuminate the space for the printing drum.

3. A stencil printer as defined in claim 1 in which the control means comprises a switch means which activates the lamp means only when the detecting means detects that the printing drum has been removed from the printer body.

4. A stencil printer as defined in claim 3 wherein said switch means comprises a drum takeout switch which is operated to permit the printing drum to be removed from the printer body.

* * * * *